US006267573B1

(12) United States Patent
Fenocchi et al.

(10) Patent No.: US 6,267,573 B1
(45) **Date of Patent: *Jul. 31, 2001**

(54) SLIDER BLOCK HARD STOP

(75) Inventors: David M. Fenocchi; Carlos A. Zamudio, both of Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/484,744

(22) Filed: Jan. 18, 2000

Related U.S. Application Data

(63) Continuation of application No. 08/989,987, filed on Dec. 12, 1997, now Pat. No. 6,053,714.

(51) Int. Cl.[7] ..... F01C 1/02
(52) U.S. Cl. ..... 418/55.5; 418/55.1; 418/57
(58) Field of Search ..... 418/55.1, 55.5, 418/57

(56) References Cited

U.S. PATENT DOCUMENTS

| | | | | |
|---|---|---|---|---|
| 4,637,786 | | 1/1987 | Matoba et al. . | |
| 5,085,565 | * | 2/1992 | Barito | 418/55.5 X |
| 5,090,878 | * | 2/1992 | Haller | 418/55.5 X |
| 5,197,868 | | 3/1993 | Caillat et al. . | |
| 5,312,229 | | 5/1994 | Sano et al. . | |
| 5,443,374 | | 8/1995 | Yoshii et al. . | |
| 5,496,158 | | 3/1996 | Barito et al. . | |
| 5,597,297 | | 1/1997 | Yamamoto et al. . | |
| 5,860,791 | | 1/1999 | Kikuchi . | |

* cited by examiner

*Primary Examiner*—Hoang Nguyen
(74) *Attorney, Agent, or Firm*—Carlson, Gaskey & Olds

(57) ABSTRACT

A scroll compressor has a fixed scroll and an orbiting scroll nested with one another within a shell. A hub extends axially from a lower surface of the orbiting scroll with a central bore formed therein. A crankshaft, having an eccentric pin extending axially from one end thereof, is drivable by a motor. A passageway for the delivery of a lubricant extends through the crankshaft and the eccentric pin. A slider block is received by the central bore, and a pin bore, which extends axially through the slider block, receives the eccentric pin. An axially extending projection maintains a gap between the slider block and the orbiting scroll which enhances the flow of lubricant to bearing surfaces of the scroll compressor.

3 Claims, 4 Drawing Sheets

SLIDER BLOCK HARD STOP

This application is a continuation of U.S. Pat. No. 08/989,987, filed on Dec. 12, 1997, and now U.S. Pat. No. 6,053,714.

INTRODUCTION

The present invention is directed to scroll type machines, e.g., scroll compressors, and, more particularly, to a scroll type machine with an improved slider block.

BACKGROUND

Scroll machines, such as scroll compressors using a fixed scroll and an orbiting scroll, are well known in the industry. Each of the scrolls of a scroll compressor has a spiral wrap extending axially from a base plate. The spiral wraps nest with one another to form pockets of varying volume. A fluid introduced into a low pressure area of the pockets is compressed by the cooperating movement of the spiral wraps, and discharged from a high pressure area proximate the center of the wraps. A motor drives a crankshaft which in turn drives the orbiting scroll along its circular orbital path via a slider block. A lubricant is typically introduced to the bearing surfaces of the compressor to reduce the friction incurred by the relative movement of the components of the compressor. Axial forces can force certain adjacent surfaces of the compressor into tight contact with one another, e.g. the top surface of the slider block and the bottom surface of the orbiting scroll, thereby restricting the flow of lubricant and correspondingly increasing friction between such surfaces of the compressor.

U.S. Pat. No. 5,197,868 to Caillat et al. discloses an axially extending recess formed in the top of a bushing of a scroll type machine which provides a limited flow path for lubricant.

It is an object of the present invention to provide a scroll compressor with a slider block which reduces or wholly overcomes some or all of the aforesaid difficulties inherent in prior known devices. Particular objects and advantages of the invention will be apparent to those skilled in the art, that is, those who are knowledgeable and experienced in this field of technology, in view of the following disclosure of the invention and detailed description of the preferred embodiments.

SUMMARY

The principles of the invention may be used to advantage to provide scroll type machines with enhanced lubricating capabilities for components of the compressors.

In accordance with a first aspect a scroll machine has a fixed scroll and an orbiting scroll nested with one another. A crankshaft, having an eccentric pin extending axially from one end thereof, is drivable by a motor. A passageway for the delivery of a lubricant extends through the crankshaft and the eccentric pin. A slider block is received by a bore formed in the orbiting scroll, and a pin bore, which extends axially through the slider block, receives the eccentric pin of the crankshaft. The bore can be formed as a well or pocket bearing or hub extending axially from, or in, a base plate of the orbiting scroll. An end surface of the slider block faces an end surface of the orbiting scroll bore. A projection extends axially from the end surface of the slider block, maintaining a gap between the slider block end surface and the end surface of the orbiting scroll bore through which lubricant may flow.

In accordance with another aspect a scroll compressor has a fixed scroll and an orbiting scroll nested with one another. A hub extends axially from a lower surface of the orbiting scroll and has a bore formed therein. A crankshaft, having an eccentric pin extending axially from one end thereof, is drivable by a motor. A flat drive surface is formed on the eccentric pin. A passageway for the delivery of a lubricant extends through the crankshaft and the eccentric pin. A slider block is received by the bore formed in the orbiting scroll hub, and has a substantially oval shaped pin bore which receives the eccentric pin of the crankshaft. The pin bore extends axially through the slider block and defines a flat driven surface drivable by the flat drive surface of the eccentric pin. A projection extends axially from an end surface of the slider block which faces a lower surface of the orbiting scroll within the bore. The slider block end surface projection maintains a gap between the slider block and the orbiting scroll through which lubricant may flow.

In accordance with yet another aspect, a slider block is formed as a substantially cylindrical member having first and second oppositely facing end surfaces, a bore extending axially from the first end surface and a projection formed on the second end surface and extending axially beyond the second end surface.

Substantial advantage is achieved by scroll machines in accordance with the disclosure, having a slider block with an axially extending projection. In particular, the flow of lubricant across the end surface of the slider block to lubricate bearing surfaces is improved. Also, the forces which act to engage the end surface of the slider block and the facing surface of the orbiting scroll are prevented from closing the gap between these surfaces, thereby reducing friction and resultant degradation of these surfaces.

From the foregoing disclosure, it will be readily apparent to those skilled in the art, that is, those who are knowledgeable or experienced in this area of technology, that the present invention provides a significant technological advance. Preferred embodiments of the scroll compressor with slider block of the present invention can provide a simple construction offering improved lubricating capabilities and reduced wear on moving parts over other known systems. These and additional features and advantages of the invention disclosed here will be further understood from the following detailed disclosure of certain preferred embodiments.

BRIEF DESCRIPTION OF THE DRAWINGS

Certain preferred embodiments are described in detail below with reference to the appended drawings wherein.

Figure 1:
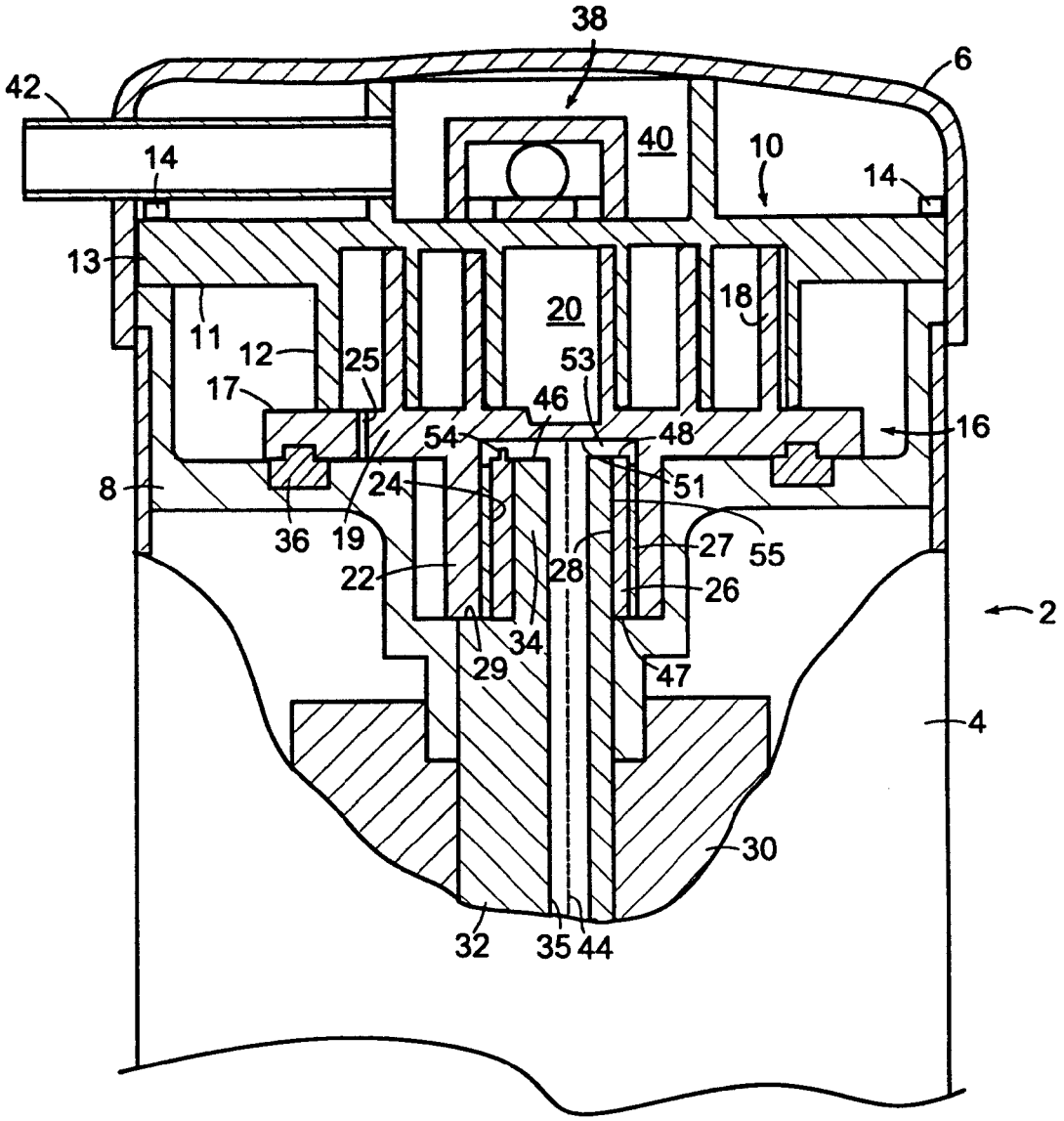
FIG. 1 is a schematic elevation view, shown partially broken away and partially in section of a scroll compressor of the present invention.

The figures referred to above are not necessarily drawn to scale and should be understood to present a simplified representation of the invention, illustrative of the principles involved. Some features of the scroll compressor depicted in the drawings have been enlarged or distorted relative to others to facilitate explanation and understanding. The same reference numbers are used in the drawings for similar or identical components and features shown in various alternative embodiments.

DETAILED DESCRIPTION OF CERTAIN PREFERRED EMBODIMENTS

Scroll type machines comprising fixed and orbiting scrolls are known in the industry for providing various functions. One such scroll type machine is a scroll compressor, used to compress a fluid such as refrigerant. Scroll machines in accordance with the invention will have configurations and components determined, in part, by the intended application and environment in which they are used. For purposes of illustration and description, the following discussion will focus on scroll compressors in accordance with certain preferred embodiments. Those skilled in the art will recognize, however, the ready application of the features and principles disclosed here to other scroll machines. Also, for convenience, the following discussion will use directional terms such as top or upward and bottom, lower or downward to refer to locations or directions for an upstanding scroll compressor design of the type illustrated in the appended drawings, unless otherwise clear from the context or from common usage regarding scroll machines.

In a first preferred embodiment, as seen in FIG. 1, scroll compressor 2 comprises substantially cylindrical housing or center shell 4, and top shell 6 secured to, preferably welded to, an upper end of center shell 4. Crankcase 8 is secured at its outer edges, preferably by spot welding, to the interior surface of center shell 4. Fixed scroll 10, having spiral wrap 12 extending axially downwardly from a lower surface 11 of base plate 13, is positioned above crankcase 8 and secured thereto by bolts 14. Orbiting scroll 16, having spiral wrap 18 extending axially upwardly from an upper surface 17 of base plate 19, is positioned between fixed scroll 10 and crankcase 8. Wraps 12, 18 nest with one another to form discrete pockets 20 between the two scrolls. Hub 22 extends axially downwardly from base plate 19 of orbiting scroll 16, with axially extending central bore 24 formed therein. In other preferred embodiments central bore 24 may be formed at or in a lower surface of an orbiting scroll 16 having no axial hub. A passage 25 is typically formed in orbiting scroll 16, putting a lower surface of base plate 19 of orbiting scroll 16 in fluid communication with an area of intermediate pressure of pockets 20, to provide an axial compliance force which biases the tips of spiral wrap 18 against base plate 13 of fixed scroll 10. A pair of circumferential gaskets (not shown) may be positioned between orbiting scroll 16 and crankcase 8, providing an annular cavity therebetween to contain such intermediate pressure fluid which provides such axial compliance force.

Figure 2:
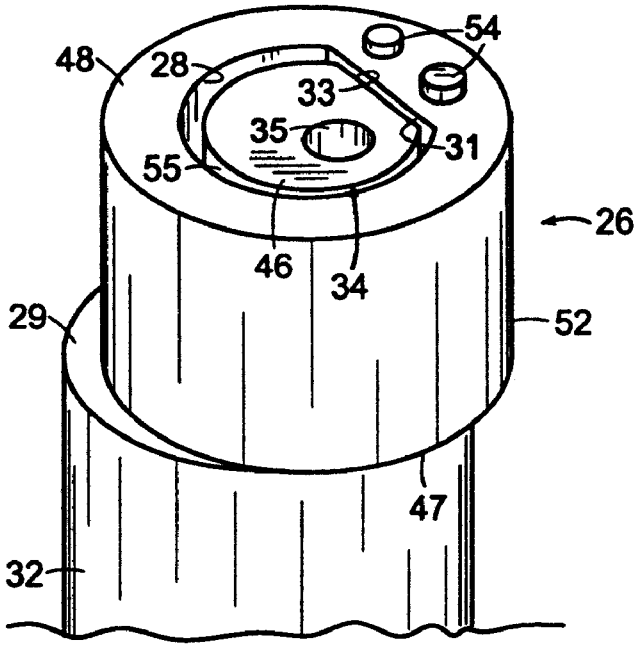
FIG. 2 is a schematic perspective view, shown partially broken away, of the slider block, crankshaft, and eccentric pin of the scroll compressor of FIG. 1.

Slider block 26, having pin bore 28 extending therethrough, is received by central bore 24 and rests on shoulder 29 at the top end of crankshaft 32. In certain preferred embodiments, bushing 27 is positioned in central bore 24 concentrically around slider block 26. Motor 30 is housed within center shell 4 and rotatably drives axially extending crankshaft 32. Eccentric pin 34 extends axially from top end 29 of crankshaft 32, having flat drive surface 33 formed thereon and is received by pin bore 28, as seen in FIG. 2. Top surface 46 of eccentric pin 34 is preferably substantially flush with top surface 48 of slider block 26. Alternatively, eccentric pin 34 can have an axial height less than that of slider block 26 above shoulder 29. Lubricant passageway 35 extends axially through crankshaft 32 and eccentric pin 34 for delivery of a lubricant such as oil from a reservoir (not shown) located in a lower portion of compressor 2.

Figure 3:
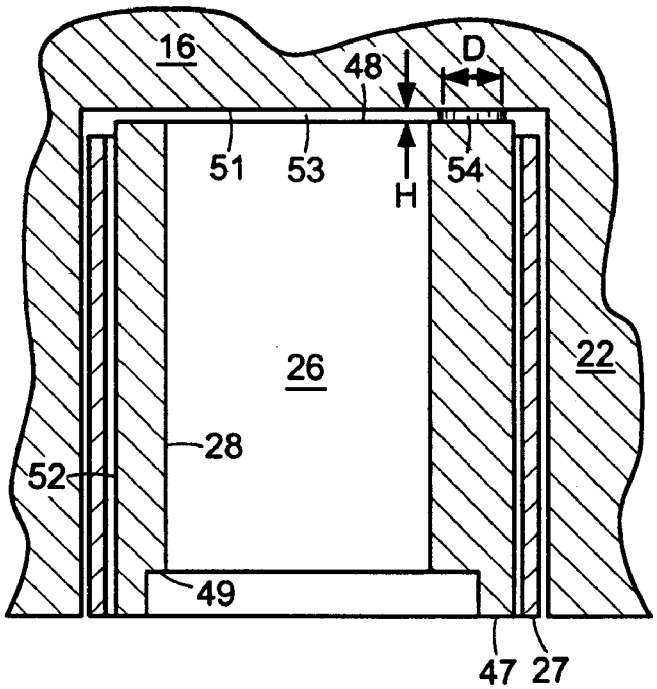
FIG. 3 is a schematic section view, shown partially broken away, of the slider block positioned within the hub of the orbiting scroll of FIG. 1.

Slider block, as used here, refers to an element used in a scroll type machine which transmits forces from an eccentric pin or the like to an orbiting scroll. In certain preferred embodiments, the slider block has a substantially cylindrical shape with a bore extending therethrough, a substantially flat first end or lower surface, and an opposed substantially flat second end or top surface, the first and second surfaces being substantially parallel to one another. Pin bore, as used here, refers to a bore within the slider block which receives an eccentric pin or the like. In the embodiments of FIGS. 1–3 pin bore 28 is an axially extending bore formed in slider block 26 and defines flat driven surface 31, as best seen in FIG. 2. Pin bore 28, in certain preferred embodiments extends through slider block 26 from its lower surface 47 to its top surface 48 with countersunk portion 49 formed at lower surface 47. In other preferred embodiments, the pin bore may extend only partially into slider block 26 from lower surface 47 a distance sufficient to receive eccentric pin 34, with lubricant passages provided to the top and/or sides of the slider block.

In operation, motor 30 rotatably drives crankshaft 32 and thus, eccentric pin 34. Flat drive surface 33 on eccentric pin 34 engages flat driven surface 31 to rotate slider block 26, thereby driving orbiting scroll 16 via slider block 26 and bushing 27. A rotation prevention mechanism, such as Oldham coupling 36, is positioned between crankcase 8 and orbiting scroll 16, or between fixed scroll 10 and orbiting scroll 16, to prevent rotation of orbiting scroll 16 as it undergoes such orbital motion. Oldham couplings and their operation are well understood by those skilled in the art and, therefore, no further description need be provided here. A fluid, typically refrigerant, is introduced into a low pressure area of pockets 20, typically proximate an outer edge of spiral wraps 12, 18. As orbiting scroll 16 orbits, pockets 20 travel spirally inward with progressively decreasing volume, thus compressing the fluid in pockets 20. The compressed fluid is discharged from a high pressure area of pockets 20, typically in a central portion thereof, via valve 38, formed on a top surface of fixed scroll 10, into chamber 40 formed by top shell 6. The compressed fluid is then discharged from chamber 40 via outlet 42, which extends through an outer surface of top shell 6.

Oil, shown by dashed lines 44, is fed upwardly through passageway 35 from a reservoir (not shown) as crankshaft 32 rotates. Oil 44 reaches top surface 46 of eccentric pin 34 and is thrown outwardly by centrifugal forces. Oil 44 travels across top surfaces 46, 48 of eccentric pin 34 and slider block 26, respectively, and then downwardly on outer surface 52 of slider block 26, the surface of bushing 27, and the surface 55 of eccentric pin 34. Oil 44 then drains back to the reservoir, completing the lubrication cycle of these bearing surfaces. When compressor 2 is operating, various vertical forces, e.g. self alignment of the rotor and stator of motor 30 during startup, may cause crankshaft 32 to move axially, forcing the end surface of slider block 26, i.e., in the embodiment shown top surface 48, against the end surface of the bore, i.e., in the embodiment shown lower surface 51 of orbiting scroll 16. This can be problematic, since the engagement of top surfaces 46, 48 with lower surface 51 can restrict oil flow across top surfaces 46, 48 and so inhibit the flow of oil to the bearing surfaces, causing increased friction and wear of the components of compressor 2.

Projection 54 extends axially from top surface 48 of slider block 26, as seen in FIG. 2. In the illustrated embodiment, projection 54 comprises two nubs positioned in the area of top surface 48 between flat driven surface 31 and outer surface 52 and spaced equally along flat driven surface 31. The top surface of projection 54 will engage lower surface 51 of orbiting scroll 16, advantageously maintaining a gap 53 between top surface 48 of slider block 26 and lower surface 51 of orbiting scroll 16, as best seen in FIG. 3. Gap 53 will therefore at all times be no less than substantially equal to the height H of projection 54. It should be recognized that the height of projection 54 preferably is sufficient, cooperatively with the height of slider block 26 acting against shoulder 29 of crankshaft 32, to maintain a gap also between top surface 46 of eccentric pin 34 and lower surface 51 of orbiting scroll 16. Gap 53 will facilitate the flow of oil across top surfaces 46, 48 to outer surface 52 of slider block 26, the surface of bushing 27 and surface 55 of eccentric pin 34, thereby advantageously reducing friction caused by the rotation of these members and increasing their working life.

Figure 6:
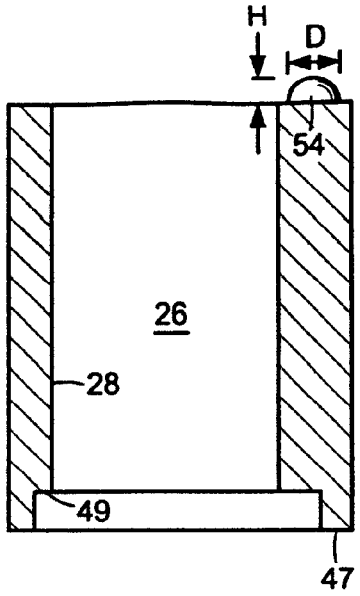
FIG. 6 is a schematic elevation view of another alternative embodiment of a slider block in accordance with the invention.

Projection, as used here, refers to an element which extends axially beyond an end surface of the slider block. The projection in certain preferred embodiments is unitary with the slider block. It may be comprised of a single nub or a plurality of nubs, as illustrated, or other forms extending axially beyond an end surface of the slider block. Referring again to slider block 26 illustrated in the drawings, in certain preferred embodiments projection 54 is positioned in the area of top surface 48 between flat driven surface 31 and outer surface 52. In certain preferred embodiments projection 54 is a right cylinder, as shown in FIG. 2, and in other preferred embodiments projection 54 is substantially dome-shaped, e.g. semi-spherical, as shown in FIG. 6. Projection 54 preferably has a height H of between approximately 0.2 mm and 1.0 mm, more preferably between approximately 0.3 mm and 0.6 mm, for example approximately 0.5 mm, and a diameter D of between approximately 2.0 mm and 5.0 mm, more preferably between approximately 2.0 mm and 3.0 mm, for example approximately 2.5 mm.

Figure 4:
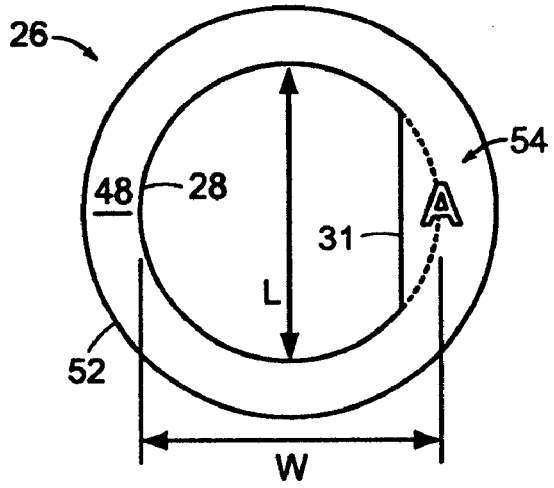
FIG. 4 is a schematic plan view of an alternative embodiment of a slider block in accordance with the invention.

In other preferred embodiments, projection 54 may comprise an alphanumeric pattern, as illustrated by the letter A in FIG. 4. Alphanumeric, as used here, refers to any combination of letters and/or numbers and/or other symbols. Such alphanumeric characters, such as for example part numbers, can provide useful information to assembly workers or automated machinery involved in the manufacture of compressor 2.

In one preferred embodiment, pin bore 28 is substantially oval shaped, as seen in FIG. 4. Specifically, the long axis, or dimension L of pin bore 28 is longer than the short axis, or dimension W, where dimension W includes the imaginary portion of pin bore 28 truncated by flat driven surface 31 (shown here by dashed lines). The oval shape of pin bore 28 provides for relative movement between eccentric pin 34 and slider block 26 which may be necessary to relieve excess pressure, e.g., when liquid is introduced to pockets 20 of compressor 2.

Figure 5:
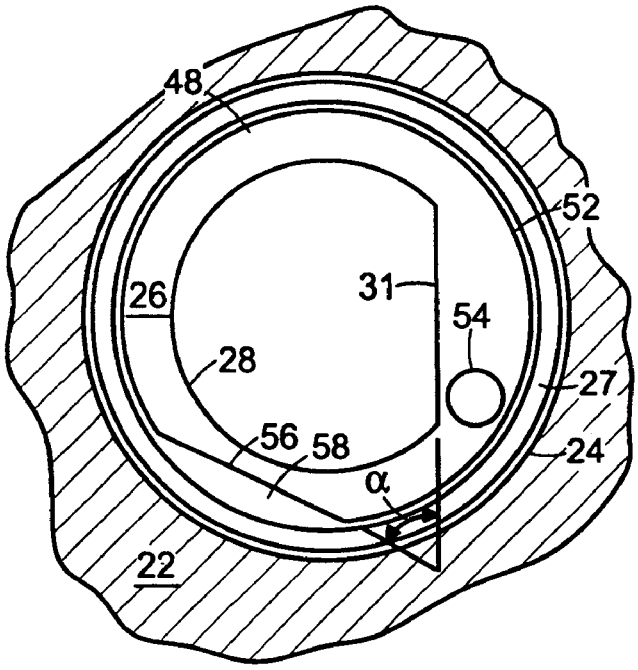
FIG. 5 is a schematic plan view of another alternative embodiment of a slider block in accordance with the invention.

In other preferred embodiments, flat portion 56 is formed on outer surface 52 of slider block 26, as seen in the alternative preferred embodiment illustrated in FIG. 5, thereby forming channel 58 extending between flat portion 56 and bushing 27 through which oil 44 may flow. The plane of flat portion 56 is offset from the plane of flat driven surface 31 by angle $\alpha$. In certain preferred embodiments, angle $\alpha$ is preferably between approximately 45° and 90°, more preferably between approximately 65° and 70°, for example approximately 67.5°. In the illustrated embodiment, projection 54 is positioned in the area of top surface 48 between flat driven surface 31 and outer surface 52, proximate the intersection of flat driven surface and pin bore 28 which is closest to flat portion 56.

Figure 7:
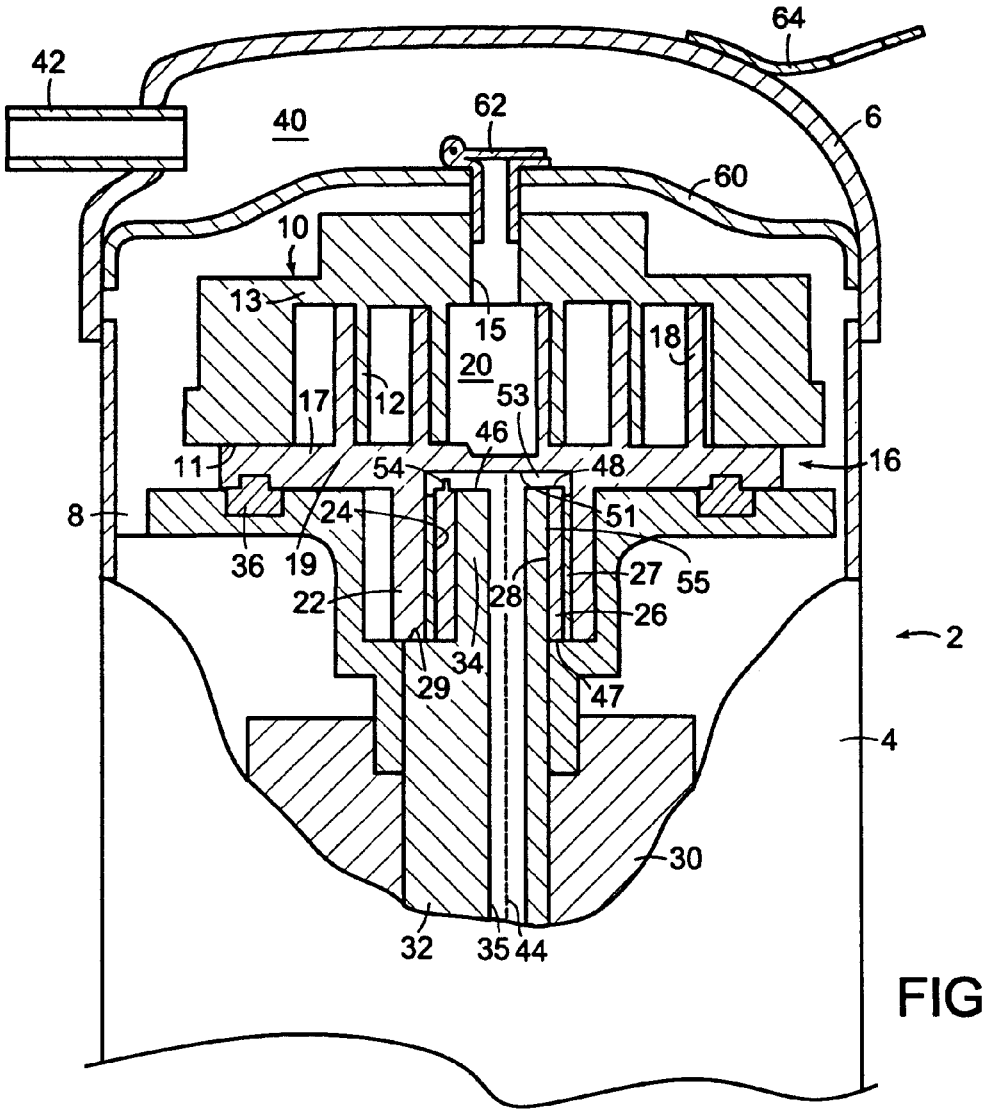
FIG. 7 is a schematic elevation view, shown partially broken away and partially in section of another preferred embodiment of the scroll compressor of the present invention.

Another preferred embodiment of scroll compressor 2 is shown in FIG. 7, having a separator plate 60 secured at its outer circumferential edge to top cap 6, forming muffler chamber chamber 40 between top cap 6 and separator plate 60. Check valve 62 is positioned on separator plate 60 and is in fluid communication with exit port 15 of fixed scroll 10. Lug 64 is provided on the exterior surface of top cap 6 to facilitate lifting compressor 2.

In light of the foregoing disclosure of the invention and description of certain preferred embodiments, those who are skilled in this area of technology will readily understand that various modifications and adaptations can be made without departing from the true scope and spirit of the invention. All such modifications and adaptations are intended to be covered by the following claims.

We claim:

1. A scroll compressor comprising:

a first scroll member having a generally spiral wrap;

a second scroll member having a generally spiral wrap fitting within said spiral wrap of said first scroll member, and having a bore with an end surface;

a motor for driving said second scroll member to orbit relative to said first scroll member;

a crankshaft having an eccentric pin extending axially from one end, and being rotatably driveable by said motor;

a slider block received within said second scroll bore, said slider block having a pin bore for receiving said eccentric pin, and an end surface facing said end surface of said second scroll member; and a projection extending axially from one end of said slider block, and maintaining a gap between said end surface of said slider block, and said end surface of said orbiting scroll bore.

2. A compressor as recited in claim 1, wherein said projection is non-removably fixed to said slider block.

3. A compressor as recited in claim 2, wherein said projection is formed integrally with said slider block.

* * * * *